United States Patent [19]

Livesay

[11] 4,291,548

[45] Sep. 29, 1981

[54] LIQUID ACCUMULATOR

[75] Inventor: J. D. Livesay, Tipp City, Ohio

[73] Assignee: General Motors Corporation, Detroit, Mich.

[21] Appl. No.: 189,135

[22] Filed: Sep. 22, 1980

Related U.S. Application Data

[63] Continuation-in-part of Ser. No. 156,320, Jul. 7, 1980.

[51] Int. Cl.[3] ..... F25B 43/00

[52] U.S. Cl. ..... 62/503; 55/463; 62/474; 210/DIG. 6

[58] Field of Search ..... 62/503, 298, 474, 475; 55/463; 210/DIG. 6

[56] References Cited

U.S. PATENT DOCUMENTS

| | | | |
|---|---|---|---|
| 3,798,921 | 3/1974 | Scherer et al. | 62/503 |
| 3,824,802 | 7/1974 | Scherer et al. | 62/503 |
| 4,111,005 | 9/1978 | Livesay | 62/503 |

*Primary Examiner*—Ronald C. Capossela
*Attorney, Agent, or Firm*—R. L. Phillips

[57] ABSTRACT

A liquid accumulator for air conditioning systems and the like having a hollow porous desiccant container which is adapted to be sealingly connected in the bottom of the accumulator's casing prior to permanent assembly thereof and wherein the desiccant container accommodates the accumulator's normal tube assembly and remains serviceable through the bottom of the casing for the adding and emptying of desiccant.

2 Claims, 9 Drawing Figures

LIQUID ACCUMULATOR

This is a continuation-in-part of application Ser. No. 156,320 filed July 7, 1980.

This invention relates to liquid accumulators and more particularly to liquid accumulators for use in air conditioning or refrigeration systems and the like.

In air conditioning or refrigeration systems such as those for automotive use, the liquid accumulator normally used in such systems has its housing or casing permanently assembled and sealed such that the desiccant contained therein is not serviceable or replaceable. As a result, the entire unit must be replaced if the desiccant becomes saturated during use and will not, or cannot, be purged in any practical manner. Furthermore, in such a conventional liquid accumulator, special handling of the desiccant is normally required to prevent moisture saturation by high humidity factory air during assembly.

The present invention is directed to providing an improved liquid accumulator for use in automotive air conditioning or refrigeration systems and the like wherein the desiccant is easily addable after the accumulator casing has been permanently assembled. As a result, the possibility of moisture accumulation is substantially reduced so there need be no special handling of the desiccant as heretofore required. Then in use and on saturation of the desiccant, there remains easy access to empty same and refill with a dry desiccant without disrupting the casing's integrity.

In the typical liquid accumulator for which the invention is adapted, the accumulator is of the type having a permanently assembled casing including liquid separator. The liquid separator includes a baffle and a generally U-shaped tube whose bight portion has a bleed opening therethrough located adjacent to and facing the bottom of the casing. Both of the tube legs extend upward and the baffle is mounted in spaced relationship over the end of one of the legs which is open to receive the vaporous refrigerant flow delivered to the evaporator beneath the shielding of the baffle while the end of the other leg is connected to pass such flow out of the accumulator onto the compressor. The baffle operates to separate liquid including refrigerant, oil and water from the vaporous refrigerant flow delivered to the accumulator and deposit same in the bottom of the casing. There the desiccant adsorbs the water while the deposited liquid refrigerant and oil is eventually aspirated through the bleed opening and thence in vaporous form through the tube out of the accumulator.

According to the present invention, there is provided a serviceable desiccant container arrangement comprising a hollow porous desiccant container which is adapted to be received in the bottom of the casing prior to the insertion of the bight portion of the tube therein and permanent assembly of the casing.

In one embodiment, the serviceable desiccant container is formed with a centrally recessed top which is adapted to receive the bight portion of the tube therein thereby leaving a hollow annulus within the desiccant container extending about the tube so as to maximize the capacity of the container in the available space in the bottom of the casing while permitting normal assembly of the tube in place. The desiccant container is further provided with an open lower end and an access opening is formed in the bottom of the casing and opens to the interior of the desiccant container through the open lower end thereof. In addition, a closure fitting is made integral with the bottom of the casing about the access opening therethrough. An annular seal-attaching arrangement operates to sealingly attach the lower end of the desiccant container in the casing so as to retain same when the casing is inverted for filling of the desiccant container through the open lower end thereof and to thereafter seal off escape of the desiccant from the interior of the desiccant container to both the interior and exterior of the casing. A detachable closure is then provided for cooperating with the closure fitting to close the access opening after the desiccant has been loaded therethrough into the desiccant container. Thus, the desiccant container may be gravity filled with desiccant both for the first time and later in service through the access opening after the casing has been permanently assembled by simply inverting same while the desiccant container remains held in place by the seal attaching replacements.

In another embodiment, the serviceable desiccant container is formed as a foldable bag that is insertable crease first in the bottom of the casing. The two folds of the bag conform on their outer side to the interior of the casing and are spaced apart on their inner side to accommodate the bight portion of the tube. An opening is provided in the crease of the bag opposite the opening in the lower end of the casing and both the bag and casing are provided with means for sealing attachment about their openings to retain the bag in place. After filling through such opening to the bag, or draining and then filling while in service, the opening through the casing as well that in the bag is closed by a cap.

These and other objects and advantages of the present invention will be more apparent from the following description and drawings in which.

Figure 1:
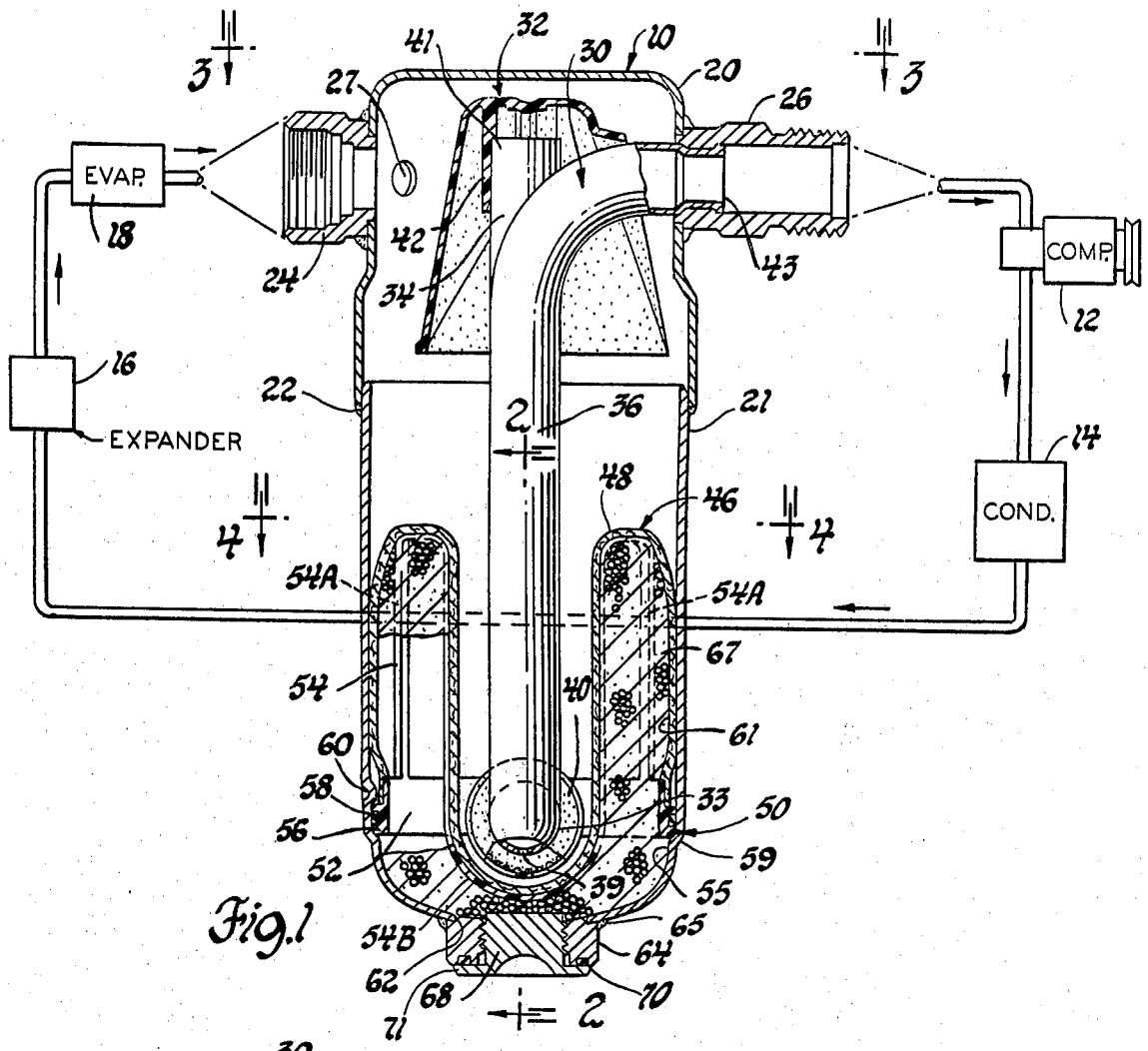
FIG. 1 is a side view of a liquid accumulator according to the present invention and also a schematic view of an automobile air conditioning system in which the accumulator is shown in use.
Figure 2:
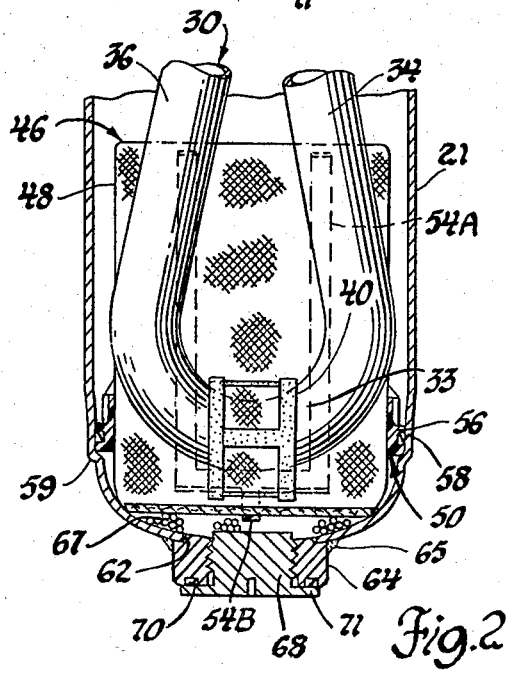
FIG. 2 is a view taken along the line 2—2 in FIG. 1.
Figure 3:
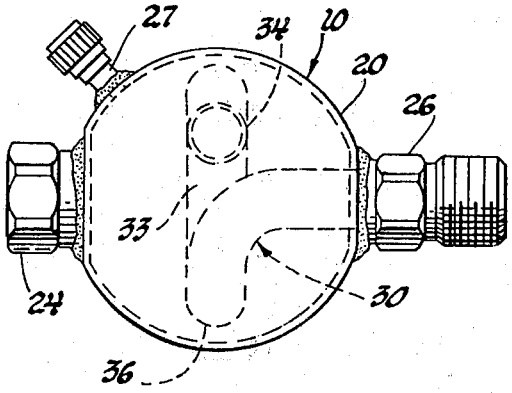
FIG. 3 is a view taken along the line 3—3 in FIG. 1.
Figure 4:
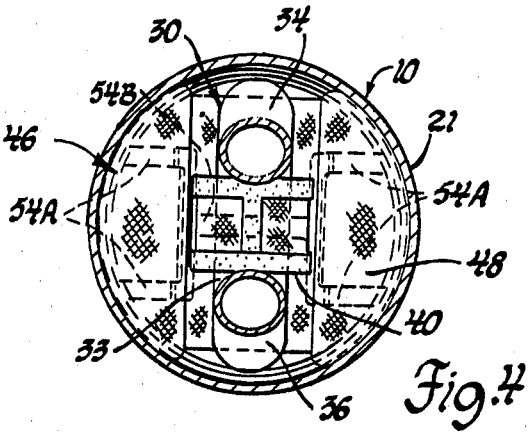
FIG. 4 is a view taken along the line 4—4 in FIG. 1.

Referring to FIGS. 1-4, there is shown a liquid accumulator 10 for an automobile air conditioning system whose other components as shown in FIG. 1 generally comprise a compressor 12 that is belt driven from the automobile's engine (not shown), a condenser 14, an expander 16 and an evaporator 18 which are all of conventional type and connected as shown in conventional manner as is well known in the art. As is also well known, the function of the liquid accumulator 10 is to separate liquid including water, oil and refrigerant from the vaporous refrigerant received from the evaporator 18 and deposit same in the bottom of the accumulator where the water is then adsorbed by desiccant stored therein while the liquid refrigerant and oil is eventually vaporized and directed onto the compressor 12 along with the vaporous refrigerant flow passing directly through the accumulator.

The liquid accumulator 10 is of the type having a permanently assembled cylindrical casing comprised of upper and lower cylindrical portions 20 and 21 which are each normally closed at one end and open at the other end and are adapted to be telescopically received together and joined at their open ends by an annular weld 22. The upper casing portion 20 whose upper end is closed, has both an inlet fitting 24 and an outlet fitting 26 by which the accumulator is connected to the line from the evaporator 18 and the line to the compressor 12, respectively. In addition, the upper casing portion 20 also has a charge fitting 27 through which the system is charged with refrigerant. Interior of the casing, there is provided a U-shaped tube 30 and a baffle 32 of truncated conical shape which are subassembled and then secured as a unit in the casing at a single joint with the upper casing portion 20 prior to joining of the lower casing portion 21 therewith.

The tube 30 has a bight portion 33 and a pair of upstanding leg portions 34 and 36. The bight portion 33 has a bleed opening or port 39 through the bottom side thereof which is located adjacent to and faces the closed bottom end of the casing while the leg portions 34 and 36 are sized to extend substantially the height of the casing. In addition, there is provided a cylindrical screen assembly 40 which is received about the bight portion 33 and serves to screen out particles in the collected liquid to prevent clogging of the bleed port 39. As also seen in FIG. 1, the leg portion 34 has an open end 41 located adjacent the closed upper end of the casing. The baffle 32 has a downwardly extending segmented cylindrical section 42 that is centrally located on the underside thereof and is press-fitted onto the tube end 41 while leaving such end open to the interior of the casing beneath the baffle. The baffle 32 is thus wholly supported by the tube and is interposed between the inlet fitting 24 and the open tube end 41 so that the incoming vaporous refrigerant is caused to impinge thereon to encourage separation of the liquid components (refrigerant, oil, water) and cause same to be deposited in the bottom of the casing. The other tube leg 36 has a right angle bend to its open end 43 which is adapted to be received in and permanently connected by swaging to the outlet fitting 26 thus providing for permanent attachment between the casing, the tube and the baffle; this affixing to the upper casing portion 20 occurring prior to joining of the lower casing portion thereto. With a suitable desiccant material such as silicon gel stored in the bottom of the casing as described in more detail later, the deposited water is adsorbed and retained thereby while the deposited liquid refrigerant and oil is eventually aspirated through the bleed port 39 in vaporous form into the tube 30 where it passes along with the vaporous refrigerant already flowing therethrough and then out the outlet fitting 26 onto the compressor 12. The above liquid accumulator baffle and tube assembly is of the type described in detail in copending U.S. Patent Application Ser. No. 101,697 entitled "Universal Internal Tube Accumulator" and assigned to the assignee of the present invention and which is hereby incorporated by reference.

According to the present invention, there is provided in the above type liquid accumulator, a serviceable desiccant container arrangement comprising a hollow porous desiccant container 46 which is adapted to be received in the lower casing portion 21 prior to insertion of the tube 30 which has been previously attached along with its accompanying baffle 32 to the upper casing portion 20 and, of course, prior to permanent assembly of the two casing portions 20 and 21. The desiccant container 46 comprises a felt sock 48 supported by a plastic frame 50 which as a circular hoop 52 at its lower end from whose upper edge extends a web arrangement 54. The web arrangement 54 includes two pairs of U-shaped ribs 54A which extend upwardly on opposite sides of the tube legs 34 and 36. The web further includes a single U-shaped rib 54B which extends underneath the bight portion 33 of the tube and connects the pairs of ribs 54A. The sock 48 is received over the rib arrangement 54 with its closed upper end inverted to nest against the bight of rib 54A and the sock's open lower end is heat sealed to the hoop 52. The resulting interior 55 of the desiccant container thus forms an annulus surrounding the lower extremity of the tube 30 and circumjacent the casing and in addition forms a well beneath the bight portion 33 of the tube thereby maximizing the capacity of the desiccant container in the available space in the bottom of the casing while permitting normal assembly of the tube therein.

Sealing and retention of the desiccant container 46 in the bottom of the lower casing portion 21 is provided by an annular radially outwardly projecting rib 56 formed integral with the desiccant container hoop 52 adjacent the lower end thereof. The annular rib 56 is grooved to retain an O-ring 58 which sealingly engages with the interior of the lower casing portion while the annular rib 56 closely fits therewith and is retained in position against an annular radially extending shoulder 59 by three equally circumferentially spaced dimples 60 formed in the lower casing portion after the desiccant container has been inserted. The interior 61 of the desiccant container 46 is thus open to the bottom of the lower casing portion 21 but is sealed from the interior of the casing above the desiccant container's hoop 52.

To provide access to the interior of the desiccant container 46 from outside the casing, there is formed an access opening 62 in the bottom of the lower casing portion 21 in which an internally threaded fitting 64 is secured by a weld 65 and thus made integral therewith. Then with the accumulator casing 20, 21 permanently assembled with the tube 30 and baffle 32 mounted therein and also the thus far empty desiccant container 46, the accumulator may be inverted to allow gravity filling of the desiccant container with dry desiccant 67 through the open female fitting 64. With the desiccant container 46 thus filled, a male plug 68 is then threaded into the fitting 64 to thus close the desiccant container and also the service opening through the lower end of the accumulator casing, there being provided an O-ring seal 70 between a shoulder 71 on the plug 68 and fitting 64 to assure there is no leakage of any matter from the accumulator. Thus, the desiccant container may be gravity filled with desiccant both for the first time and later in service through the access opening after the casing has been permanently assembled simply in inversion thereof and removal of the threaded plug 68. Furthermore, the desiccant container can be drained of saturated desiccant while in its normal attitude. It will also be appreciated that since the threads at the access opening to the desiccant container are internal, they are thus protected from weld spatter during attachment of the female fitting to the casing and also during handling.

Figure 5:
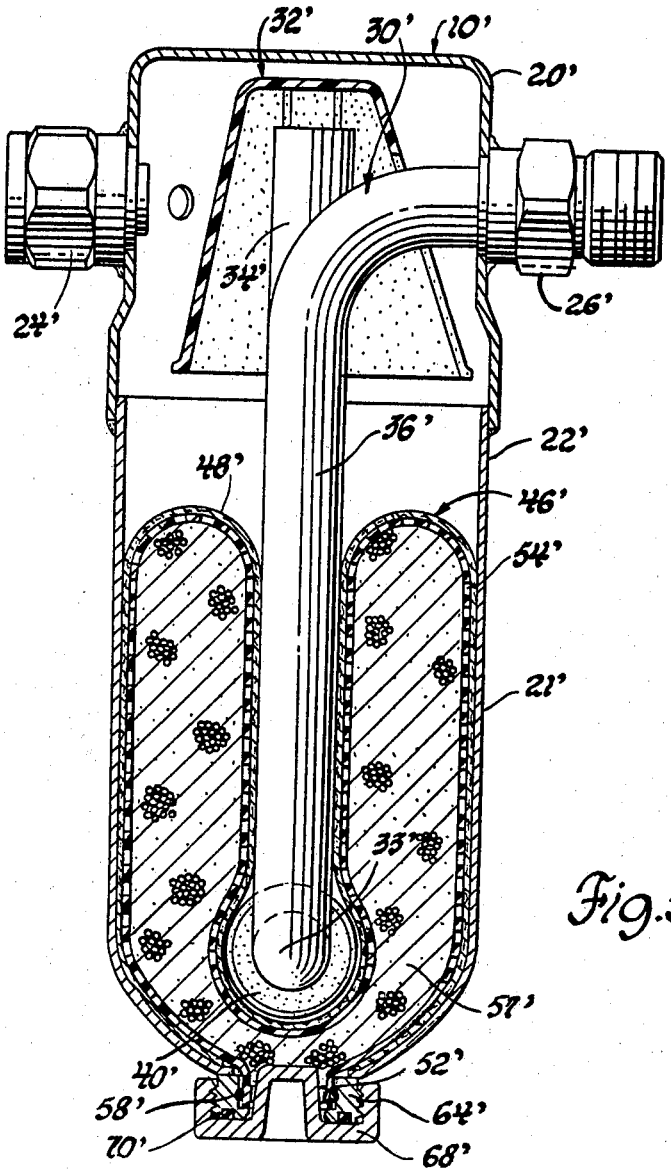
FIG. 5 is a side sectional view of another embodiment of the liquid accumulator according to the present invention.

Another embodiment of the serviceable desiccant container arrangement according to the present invention is shown in FIG. 5 wherein parts similar to those in FIGS. 1–4 are identified by the same numbers only primed. Describing the distinguishing features in the FIG. 5 embodiment, the retainer hoop 52' is reduced in diameter as compared with that in FIGS. 1–4 so as to provide a snap fit through the sealing ring 58' with the access fitting 64' which is now internally grooved to accommodate the sealing ring and externally threaded to accept the now internally threaded plug 68'. Furthermore, the retainer support 54' for the felt bag 48' is now simply a preformed perforated shell rather than a web arrangement.

Figure 6:
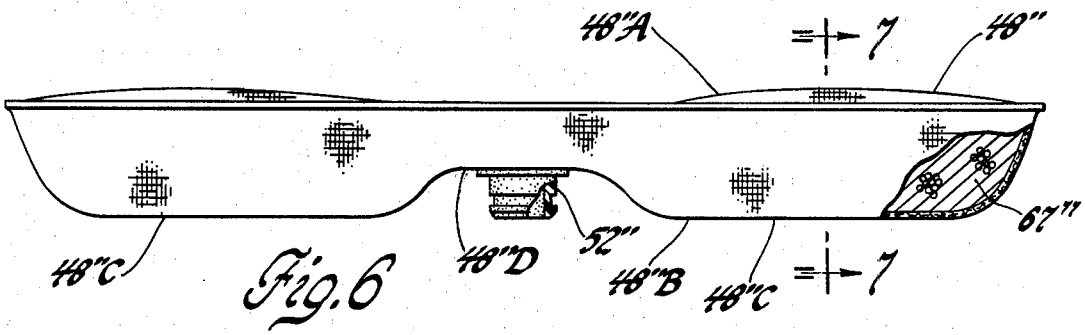
FIG. 6 is a side view of another embodiment of the serviceable desiccant container according to the present invention, such being in the form of a foldable bag which is shown in its unfolded state.
Figure 7:
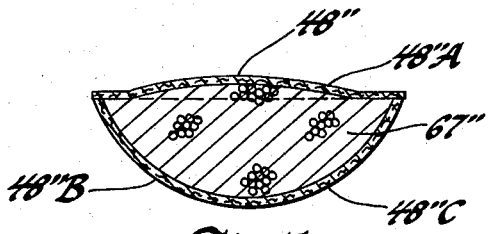
FIG. 7 is a view taken along the line 7—7 in FIG. 6.
Figure 8:
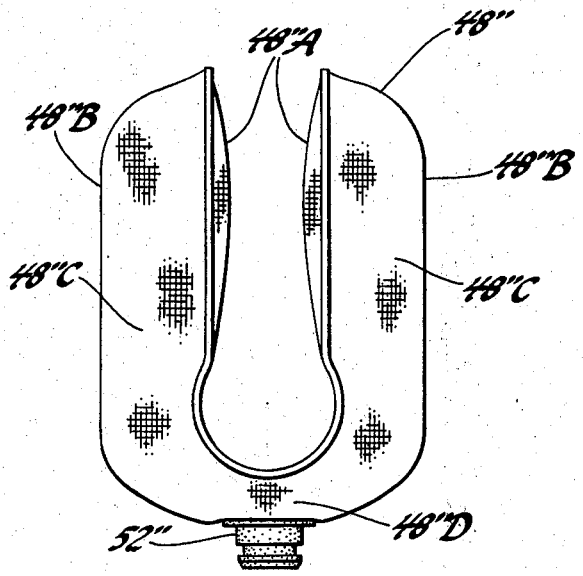
FIG. 8 shows the desiccant bag in FIG. 6 in its folded as-inserted state.
Figure 9:
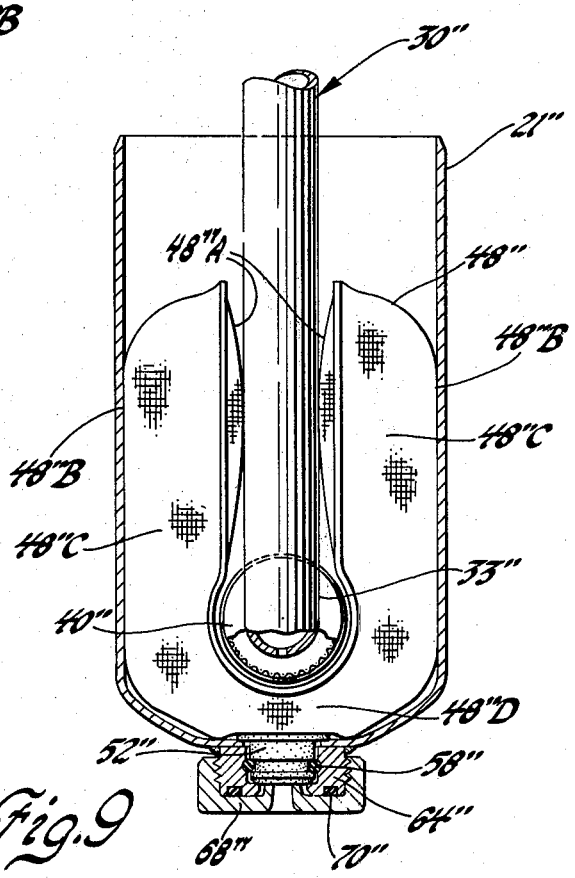
FIG. 9 is a view similar to FIG. 2 but showing installation of the desiccant bag in FIG. 6.

Another embodiment of the desiccant container arrangement according to the present invention is shown in FIGS. 6–9 wherein parts similar to those in FIGS. 1–5 are identified by the same numbers only double primed. Describing the distinguishing features, the serviceable desiccant container in this embodiment simply comprises a felt bag 48" formed from two originally flat panels 48"A and 48"B. The panels 48"A and 48"B are cut to shape and sealingly bonded together along their periphery after the one panel 48"B has been preformed with two deeply depressed sections 48"C interconnected by an intermediate shallow depressed section 48"D to form a cavity therebetween for the desiccant 67" as shown in FIGS. 6 and 7. The bag 48" as manufactured is stretched out as shown in FIG. 6 but is foldable once on itself with the depressed side 48"B out as shown in FIG. 8 so as to then be insertable crease first in the bottom of the lower casing portion 21" as shown in FIG. 9. The two folds at their outer side 48"B are contoured to conform with the interior side of the casing while being spaced apart at their relatively flat inner side 48"A to accommodate the bight portion 33" of the tube 30" with the screen assembly 40" thereon. The bag 48" further has a male fitting 52" sealingly bonded to its side 48"B about an opening therethrough at the crease. Like in the FIG. 5 embodiment, the male fitting 52" has a snap fit through the sealing ring 58" with the access fitting 64" which is internally grooved to accommodate the sealing ring and externally threaded to accept the closure plug or cap 68".

Having described the above embodiments, it will be understood that the invention may be modified within the scope of the appended claims.

The embodiments of the invention in which an exclusive property or privilege is claimed are defined as follows:

1. In a liquid accumulator for air conditioning systems and the like wherein the accumulator is of the type having a permanently assembled casing enclosing both liquid separator means and desiccant container means and wherein the liquid separator means includes a generally U-shaped tube having a bight portion with a bleed opening therethrough located in a bottom end of the casing and wherein the liquid separator means operates to separate liquid including refrigerant, oil and water from vaporous refrigerant flow received from the system and deposit same in the bottom of the casing and wherein desiccant in the desiccant container means adsorbs the deposited water while the deposited liquid refrigerant and oil is permitted to be returned through the bleed opening in the bight portion and thence through the tube in vaporous form back to the system: the improvement in a serviceable desiccant container arrangement comprising in combination, a porous desiccant container bag with closed ends that is foldable once on itself and is then insertable crease first in the bottom of the casing prior to insertion of the bight portion of the tube therein and permanent closure of the casing, the two folds of said bag having an outer side shaped to conform with the interior side of the casing and an inner side facing toward and spaced from that of the other fold so as to receive the bight portion of the tube therebetween, said bag at the crease therein having an opening aligned with an opening in the bottom of the casing, fitting means on both said bag and the casing extending about their respective opening for cooperating with each other to sealingly attach said bag to the casing so as to retain said bag in the bottom of the casing when the latter is inverted and also seal off the interior of said bag from the interior of the casing, and closure means for closing the opening in the casing after desiccant has been loaded therethrough into said bag whereby said bag may be gravity filled both for the first time and later in service through said opening in the casing after said casing has been permanently closed and inverted while said bag while so inverted is retained by said fitting means and whereby saturated desiccant may be drained from said bag through the opening in the casing when the casing is in its normal upright position prior to refilling.

2. In a liquid accumulator for air conditioning systems and the like wherein the accumulator is of the type having a permanently assembled casing enclosing both liquid separator means and desiccant container means and wherein the liquid separator means includes a generally U-shaped tube having a bight portion with a bleed opening therethrough located in a bottom end of the casing and wherein the liquid separator means operates to separate liquid including refrigerant, oil and water from vaporous refrigerant flow received from the system and deposit same in the bottom of the casing and wherein desiccant in the desiccant container means adsorbs the deposited water while the deposited liquid refrigerant and oil is permitted to be returned through the bleed opening in the bight portion and thence through the tube in varporous form back to the system: the improvement in a serviceable desiccant container arrangement comprising in combination, a porous desiccant container bag comprising a pair of felt panels sealingly bonded together along their periphery, at least one of said panels being preformed with a depression so as to form a cavity between said panels for the desiccant, said bag being originally formed in a stretched out state and foldable once on itself with the depressed panel facing outward for insertion crease first in the bottom of the casing prior to insertion of the bight portion of the tube therein and permanent closure of the casing, the two folds of said bag having a contoured outer side provided by the depressed panel conforming with the interior side of the casing and a relatively flat inner side provided by the other panel facing toward and spaced from that of the other fold so as to receive the bight portion of the tube therebetween, said bag at the crease therein having an opening aligned with an opening in the bottom of the casing, fitting means on both said bag and the casing extending about their respective opening for cooperating with each other to sealingly attach said bag to the casing so as to retain said bag in the bottom of the casing when the latter is inverted and also seal off the interior of said bag from the interior of the casing, and closure means for closing the opening in the casing after desiccant has been loaded therethrough into said bag whereby said bag may be gravity filled both for the first time and later in service through said opening in the casing after said casing has been permanently closed and inverted while said bag while so inverted is retained by said fitting means and whereby saturated desiccant may be drained from said bag through the opening in the casing when the casing is in its normal upright position prior to refilling.

* * * * *

UNITED STATES PATENT AND TRADEMARK OFFICE

CERTIFICATE OF CORRECTION

PATENT NO. : 4,291,548

DATED : September 29, 1981

INVENTOR(S) : J. D. Livesay

It is certified that error appears in the above—identified patent and that said Letters Patent is hereby corrected as shown below:

Column 4, line 7, "as" should read -- has --.

Column 4, line 61, "in" should read -- by --.

Column 6, line 42, "varporous" should read -- vaporous --.

Signed and Sealed this

*Thirteenth* Day of *July 1982*

[SEAL]

*Attest:*

GERALD J. MOSSINGHOFF

*Attesting Officer*

*Commissioner of Patents and Trademarks*